US009957789B2

(12) United States Patent
Hallundbæk

(10) Patent No.: US 9,957,789 B2
(45) Date of Patent: May 1, 2018

(54) DOWNHOLE SYSTEM HAVING A WIRELESS UNIT

(75) Inventor: Jorgen Hallundbæk, Græsted (DK)

(73) Assignee: WELLTEC A/S, Allerod (DK)

( * ) Notice: Subject to any disclaimer, the term of this patent is extended or adjusted under 35 U.S.C. 154(b) by 228 days.

(21) Appl. No.: 13/989,265

(22) PCT Filed: Nov. 23, 2011

(86) PCT No.: PCT/EP2011/070821

§ 371 (c)(1),
(2), (4) Date: May 23, 2013

(87) PCT Pub. No.: WO2012/069541

PCT Pub. Date: May 31, 2012

(65) Prior Publication Data

US 2013/0241741 A1 Sep. 19, 2013

(30) Foreign Application Priority Data

Nov. 24, 2010 (EP) ..... 10192398

(51) Int. Cl.
*G01V 3/00* (2006.01)
*E21B 44/02* (2006.01)
(Continued)

(52) U.S. Cl.
CPC ..... *E21B 44/02* (2013.01); *E21B 23/00* (2013.01); *E21B 47/16* (2013.01); *E21B 2023/008* (2013.01)

(58) Field of Classification Search
CPC ..... E21B 43/00; E21B 23/04; G01V 3/00
(Continued)

(56) References Cited

U.S. PATENT DOCUMENTS 5,947,213 A 9/1999 Angle et al.
6,046,685 A * 4/2000 Tubel ..... 340/853.2
(Continued)

FOREIGN PATENT DOCUMENTS

RU 2 236 549 C2 9/2004
RU 2 354 801 C2 7/2008
(Continued)

OTHER PUBLICATIONS

International Preliminary Report on Patentability issued in International Application No. PCT/EP2011/070821 dated May 28, 2013.
(Continued)

*Primary Examiner* — Amine Benlagsir
(74) *Attorney, Agent, or Firm* — Nixon & Vanderhye PC

(57) ABSTRACT

The present invention relates to a downhole system (200) comprising a casing (3) having an inner wall. Furthermore, the downhole system comprises a wireless unit (1) which is movable within the casing, comprising driving means (7) in the form of wheels and at least one battery pack (8) comprising at least one battery for powering an electrical motor (5) driving a pump (6) driving the wheels to rotate along the inner wall of the casing, wherein the downhole system further comprises a well head (110) having a sound detection device (16) for detecting vibrations in the casing, e.g. caused by the driving means or an operation performed by the wireless unit.

17 Claims, 5 Drawing Sheets

(51) Int. Cl.
*E21B 23/00* (2006.01)
*E21B 47/16* (2006.01)

(58) Field of Classification Search
USPC ..... 340/853.6; 166/373, 255.1, 381, 66.7, 166/250.01; 73/40.5 R; 702/56
See application file for complete search history.

(56) References Cited

U.S. PATENT DOCUMENTS

| | | | | |
|---|---|---|---|---|
| 6,454,011 | B1 * | 9/2002 | Schempf et al. | 166/381 |
| 2002/0084071 | A1 * | 7/2002 | McCoy | E21B 43/121 166/255.1 |
| 2002/0108747 | A1 * | 8/2002 | Dietz et al. | 166/66.7 |
| 2003/0117133 | A1 * | 6/2003 | Miszewski et al. | 324/207.26 |
| 2003/0234110 | A1 * | 12/2003 | McGregor | 166/373 |
| 2005/0241824 | A1 * | 11/2005 | Burris et al. | 166/255.1 |
| 2008/0105424 | A1 * | 5/2008 | Remmert et al. | 166/250.01 |
| 2010/0305864 | A1 * | 12/2010 | Gies | E21B 47/01 702/9 |
| 2012/0222900 | A1 * | 9/2012 | Rodney | E21B 44/00 175/56 |
| 2013/0030724 | A1 * | 1/2013 | Friedlander et al. | 702/56 |

FOREIGN PATENT DOCUMENTS

| | | |
|---|---|---|
| WO | 1992/013167 | 8/1992 |
| WO | WO 93/18277 | 9/1993 |

OTHER PUBLICATIONS

International Search Report for PCT/EP2011/070821, dated Dec. 29, 2011.
Written Opinion of the International Searching Authority for PCT/EP2011/070821, dated Dec. 29, 2011.
Patent Examination Report No. 2 for Australian Application No. 2011333810, four pages, dated May 25, 2015.

* cited by examiner

DOWNHOLE SYSTEM HAVING A WIRELESS UNIT

This application is the U.S. national phase of International Application No. PCT/EP2011/070821, filed 23 Nov. 2011, which designated the U.S. and claims priority to EP Application No. 10192398.5, filed 24 Nov. 2010, the entire contents of each of which are hereby incorporated by reference.

FIELD OF THE INVENTION

The present invention relates to a downhole system comprising a casing having an inner wall. Furthermore, the downhole system comprises a wireless unit which is movable within the casing, comprising driving means in the form of wheels and at least one battery pack.

BACKGROUND ART

During oil production, it may become necessary to perform maintenance work in a well or to open a production well. Such well work is known as well intervention. A production casing is arranged inside the well and is closed by a well head in its upper end. The well head may be placed on shore, on an oil rig or on the seabed.

In order to lower and raise the tool into and out of the well and supply the tool with electricity, the tool is connected to a wireline at its top, which is fed through the well head. In order to seal the well while performing the operation using the tool, the wireline passes through a high-pressure grease injection section and sealing elements for sealing around the wireline.

In order to seal around the wireline as it passes through the grease injection section, high-pressure grease is pumped into the surrounding annulus to effect a pressure-tight dynamic seal which is maintained during the operation by injecting more grease as required. A slight leakage of grease is normal, and the addition of fresh grease allows for the consistency of the seal to be maintained at an effective level. In this way, grease leaks from the grease injection section into the sea during an intervention operation, which is not environmentally desirable. Due to the increasing awareness of the environment, there is a need for a more environmentally friendly solution.

SUMMARY OF THE INVENTION

It is an object of the present invention to wholly or partly overcome the above disadvantages and drawbacks of the prior art. More specifically, it is an object to provide an improved wireless tool for operating in a well without requiring the use of a wireline or a similar powerline.

The above objects, together with numerous other objects, advantages, and features, which will become evident from the below description, are accomplished by a solution in accordance with the present invention by a downhole system comprising:

- a casing having an inner wall, and
- a wireless unit which is movable within the casing, comprising driving means in the form of wheels and at least one battery pack comprising at least one battery for powering an electrical motor driving a pump driving the wheels to rotate along the inner wall of the casing, wherein the downhole system further comprises a well head having a sound detection device for detecting vibrations in the casing, e.g. caused by the driving means or an operation performed by the wireless unit.

In one embodiment, the sound detection device may be a geophone.

Also, the sound detection device may be arranged in contact with the casing.

In this way, the personnel operating the unit are able to determine the position of the unit without communicating directly with the wireless unit. Furthermore, when the driving means of the wireless unit pass a casing collar, the difference in sound or vibrations can be detected, thereby enabling calculation of the position of the wireless unit based on the number of casing collars passed by the unit. Furthermore, if the wireless unit accidentally stops due to an unexpected hindrance, the operator will be informed and can then retract the unit and start over.

Having a sound detection device provides an extra precautionary measure to ensure that the wireless unit is in position for performing an operation or is sufficiently close to the downhole safety valve to open the valve and be let through. If other safety arrangement fails which is arranged downhole, these arrangements are not easily replaced as they are situated in the well approximately 300 meters down. However, replacing a sound detection device in the well head is easy, and it is even easier if the sound detection device is arranged on the other surface of the well head forming part of the outer surface.

In addition, the downhole system may comprise a control device arranged in communication with the wireless unit in the well and in communication with the sound detection device to control the wireless unit based on the sound pattern detection by the sound detection device.

Hereby, operations performed by the wireless unit can be monitored while performing an operation. Thus, an operation not sounding according to the specification which is made from earlier performed similar operations can be stopped before the operation goes wrong, and the operation may possibly be started again. More importantly, an operation performed according to the sound specification can prove to the operator that the operation was performed correctly. Thus, having a sound detection device allows for the possibility of stopping an operation before it goes wrong and ruins the well. Hence, the risk of an operation causing more damage than it actually solves is reduced.

The control device may be arranged in connection with the power box or at least in communication with the power box.

Furthermore, the wireless unit does not have to be able to communicate with its operator while being in the well as the operator is able to detect any actions and the wireless unit can be programmed to return after a certain amount of time with the data representing the operation performed. When the wireless unit is not connected to a wireline, a grease connection head is unnecessary, which improves the environmental safety.

Moreover, the sound detection device may comprise a display showing the vibrations detected in the casing, e.g. in the form of a curve illustrating the vibrations.

Furthermore, the detection device may comprise a transducer or sensor abutting an outer wall of the well head.

Also, the sound detection device may be an acoustic-to-electric transducer or sensor that converts sound into an electrical signal.

The transducer may be arranged at the top end of the well head.

The downhole system may further comprise a processor for calculating a distance from the well head to the wireless unit.

Furthermore, the processor may communicate wirelessly with the detection device by means of acoustics, electromagnetics, Wi-Fi, ZigBee, wireless LAN, DECT, GSM, UWB, UMTS, Bluetooth, sonic or radio frequency.

In addition, the downhole system may further comprise a downhole safety valve arranged in the casing.

In an embodiment, the detection device may be able to communicate with the downhole safety valve and instruct it to open when the wireless unit is within a predetermined distance from the well head.

In another embodiment, the downhole system may further comprise a docking station enabling the wireless unit to connect thereto in order to be charged or recharged, or to upload or download information or signals to and from the wireless unit.

Moreover, the docking station may be arranged in the well head.

By having the docking station in the well head and not in a sidetrack, the docking station may be easily replaced. Furthermore, the well head does not have to be of an increased diameter so as to also accommodate the insertion of a sidetrack when completing the well as in known solutions. When having a sidetrack, the inner diameter of the well head has to be larger than in a well without a sidetrack in order that the casing with sidetrack can be inserted into the well to make the well.

The wireless unit may comprise a wireless connection for transferring electricity and/or data to and from the wireless unit.

Furthermore, the well head may comprise a recharge connection for recharging and/or transferring electricity and/or data to and from the wireless unit.

The recharge connection makes it unnecessary to let the wireless unit out of the fluid-tight well head or well for recharging.

Moreover, the recharge connection may comprise an inductive coupling.

Additionally, the well head may comprise a tubular section having a wall around which the recharge connection is arranged, enabling recharging and/or transfer of electricity and/or data to and from the wireless unit through the wall of the tubular section.

Also, the well head may comprise a tubular section having an end which has an inner face and an outer face, and the recharge connection may be arranged at the outer face of the end, enabling recharging and/or transfer of electricity and/or data to and from the wireless unit through the end of the tubular section.

Furthermore, the wireless unit may comprise an inductive coupling.

In an embodiment, the downhole system may further comprise a lubricator which is connectable with the end of the tubular section, and wherein the recharge connection is arranged around the lubricator, enabling recharging and/or transfer of electricity and/or data to and from the wireless unit through a wall of the lubricator.

Moreover, the downhole system may comprise a lubricator with an end having an inner face and an outer face, which is connectable with the end of the tubular section, and wherein the recharge connection is arranged at the outer face of the end of the lubricator, enabling recharging and/or transfer of electricity and/or data to and from the wireless unit through the end wall of the lubricator.

In addition, the downhole system may comprise a recharge tool which is submergible in the casing.

Hereby, the wireless unit can be recharged without it being necessary to enter the well head or lubricator, and the wireless unit thereby does not have to waste power travelling the distance from the recharge tool to the well.

The recharge tool may be submerged via a wireline or a powerline.

Furthermore, the recharge tool may comprise a recharge connection for recharging and/or transferring electricity and/or data to and from the wireless unit.

In addition, the recharge connection may comprise an inductive coupling for recharging and/or transferring electricity and/or data to and from the wireless unit.

Finally, the recharge tool may comprise a docking station enabling the wireless unit to connect with the wireless unit and be charged or recharged, or to upload or download information or signals to and from the wireless unit.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1:
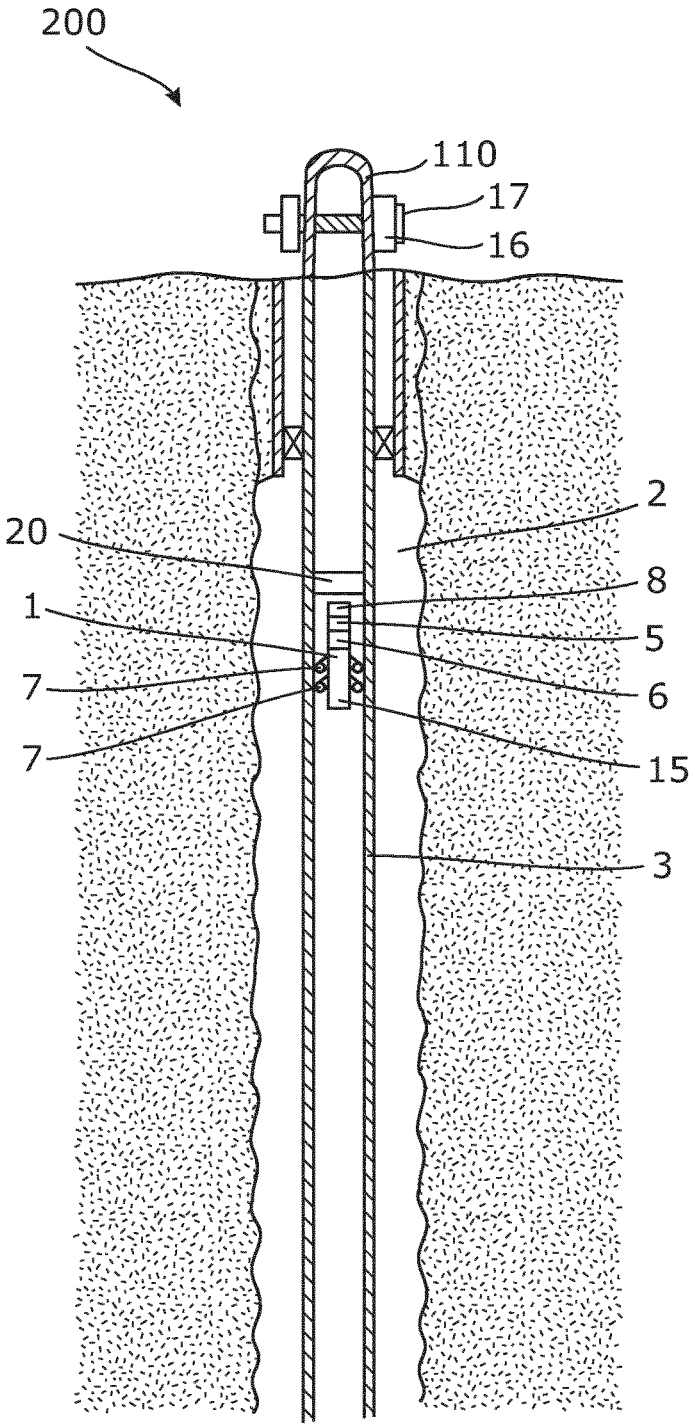
FIG. 1 shows a wireless downhole unit arranged in a casing in a well.

FIG. 1 shows a downhole system 200 comprising a wireless downhole unit 1, 100 arranged inside a casing 3 in a well 2 downhole. The wireless downhole unit 1, 100 comprises a driving unit 15 having driving means 7 in the form of wheels running along an inner wall 4 of the casing 3. The wireless downhole unit 1, 100 is typically used to drive an operational tool into the well 2 to perform an operation, such as opening a sleeve, measuring a temperature and/or pressure of the well fluid, logging the condition of the casing with regard to leaks, etc. The wireless downhole unit 1, 100 is thus connected to a wide range of operational tools and sometimes several tools at a time.

In order to propel itself along the casing wall, the wireless downhole unit 1, 100 comprises wheels which are driven by a pump 6 driven by an electrical motor 5. The wireless downhole unit 1, 100 comprises a battery pack 8 for powering the electrical motor 5, comprising a plurality of batteries. The battery pack 8 is arranged in the part of the wireless downhole unit 1, 100 which is closest to the well head 110. By placing the battery pack 8 and thus the batteries in the outermost end closest to the top of the well 2, the batteries can easily be recharged or replaced just by entering the well head.

The well head comprises a tubular section 111 and an end 112 having an inner face 113 and an outer face 114. The well head 110 further comprises a sound detection device 16 for detecting vibrations in the casing 3 caused by the driving means 7, such as the wheels. When the wireless unit 1, 100 propels itself back and forth within the well, the wheels rotate along the inner wall 4 of the casing 3 and cause vibrations which can be detected by the sound detection device 16. The closer the wireless unit 1, 100 is to the sound detection device 16, the higher a sound can be detected, thereby enabling calculation of the distance between the wireless unit and the sound detection device.

The personnel operating the wireless unit 1, 100 are able to determine the position of the unit without communicating directly with it. Furthermore, when the driving means 7 of the wireless unit 1, 100 pass a casing collar, the difference in sound or vibrations can be detected, thereby enabling calculation of the position of the wireless unit based on the number of casing collars passed by the unit. If the wireless unit 1, 100 accidentally stops due to an unexpected hindrance, the operator will be informed and can then retract the unit and start over.

Furthermore, the wireless unit 1, 100 does not have to be able to communicate with its operator while being within the well as the operator is able detect any actions based on the sounds and thus, the wireless unit 1, 100 can initially be programmed to return after a certain amount of time with the data representing the operation performed so that no communication is necessary. When the wireless unit is not connected to a wireline, a grease connection head is unnecessary, which improves the environmental safety.

A sound detection device in the well head or in the vicinity of the well head provides an extra precautionary measure to ensure that the wireless unit is in position for performing an operation or is sufficiently close to the downhole safety valve to open the valve and be let through. Replacing a sound detection device in the well head is easier than replacing a safety arrangement arranged downhole, and it is even easier if the sound detection device is arranged on the other surface of the well head forming part of the outer surface.

In addition, the downhole system may comprise a control device arranged in communication with the wireless unit in the well and in communication with the sound detection device to control the wireless unit based on the sound pattern detection by the sound detection device. Operations performed by the wireless unit can be monitored while performing an operation.

A specification of how a certain operation downhole sounds when performed correctly can be made from a plurality of runs and subsequently, an operation not sounding according to this specification can be stopped before the operation goes wrong, and the operation may possibly be started again. More importantly, an operation performed according to the sound specification can prove to the operator that the operation was performed correctly. Thus, having a sound detection device allows for the possibility of stopping an operation before it goes wrong and ruins the well. Hence, the risk of an operation causing more damage than it actually solves is reduced.

At surface a power box is often arranged from which the downhole wireless unit is operated, and the control device can be arranged in connection with this power box or at least in communication with the power box.

Figure 2:
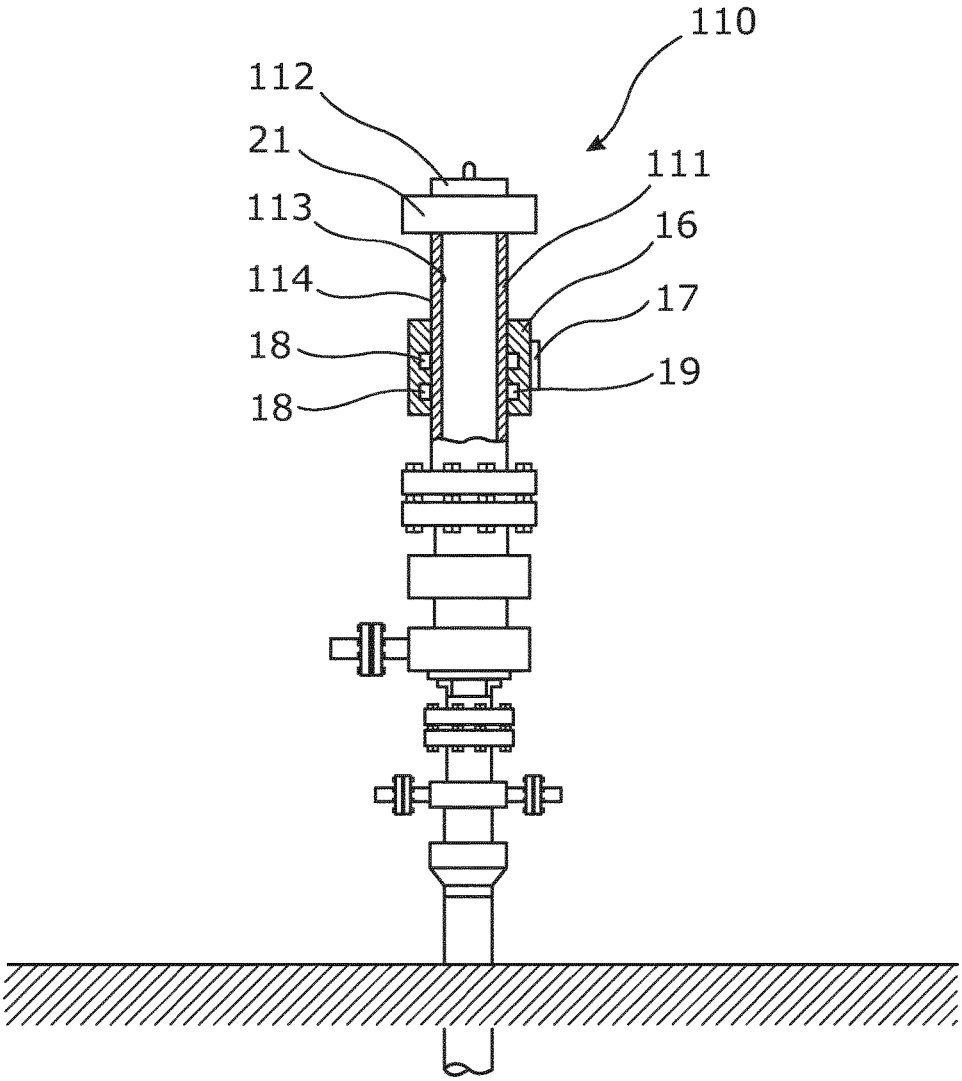
FIG. 2 shows a well head having a sound detection device.

As shown in FIG. 2, the sound detection device 16 comprises a display 17 showing the detected vibrations, e.g. in a curve illustrating the vibrations, enabling the operator to follow the wireless unit 1, 100 in the casing. In order to measure the vibrations, the detection device 16 comprises a transducer 18 or sensor 18 abutting an outer face 114 of the well head 110. Based on the loudness of the sound, a distance from the well head 110 to the wireless unit 1, 100 can be calculated by means of a processor 19 arranged in the detection device 16. The processor 19 may also be arranged at surface, and when this is the case, the data representing the detected vibrations is sent to the processor by means of a communication line. The display 17 may also be read by means of an ROV (Remote Operating Vehicle) having a camera, and when this is the case, the image of the display is sent to surface through a cable of the ROV.

The sound detection device may comprise any kind of transducer capable of detecting sound from a metal casing, such as any kind of audio recorders, geophone or microphone being an acoustic-to-electric transducer or sensor that converts sound into an electrical signal. The transducer, geophone or microphone is adhered to the metal casing of the well head to allow for detection of the sound/vibrations coming from the wheels of the driving means or from an operational tool in operation.

The detection device 16 may be mounted around any existing well head 110 if the transducers 18 are mounted firmly and abut the outer face 114 of the wall 115 of the well head 110, enabling the transducers to detect any vibrations properly. Several transducers 18 may be mounted along the wall 115 of the well head 110. The housing of the detection device 16 may be extendible in length, e.g. in the form of an adjustable coupler, to be able to adapt to different types of well heads 110.

If the processor 19 is arranged at surface, it can also communicate wirelessly with the detection device 16 by means of acoustics, electromagnetics, Wi-Fi, ZigBee, wireless LAN, DECT, GSM, UWB, UMTS, Bluetooth, sonic or radio frequency.

As shown in FIG. 1, the downhole system 200 comprises a downhole safety valve 20 arranged at the top of the casing 3. This valve 20 functions as an additional safety installation if an accident occurs while the wireless unit is in the well, causing the valves of the well head 110 to stop functioning properly, the rig to loose its connection to the well head, etc. Since the downhole safety valve is thus closed, the wireless unit 1, 100 has to wait for a signal before passing the downhole safety valve. Due to the sound detection device 16, the operator is informed when the wireless unit 1, 100 approaches the valve, which enables him to let the unit pass if safety allows it.

In FIG. 2, the downhole system 200 comprises a docking station 21 at the end of the well head 110. The docking station 21 is thus an addition piece of pipe mounted onto the well head 110. The docking station 21 may be connected to the wireless unit for charging or recharging, or for uploading or downloading information or signals to and from the wireless unit 1, 100. When necessary, the wireless unit 1, 100 docks itself into the docking station 21 to be loaded with power and/or to upload or download information or signals to and from the wireless unit. The wireless unit 1, 100 has connections matching the connections of the docking station 21 so as to fit into the docking station and in this way provide an electrical connection.

Figure 3:
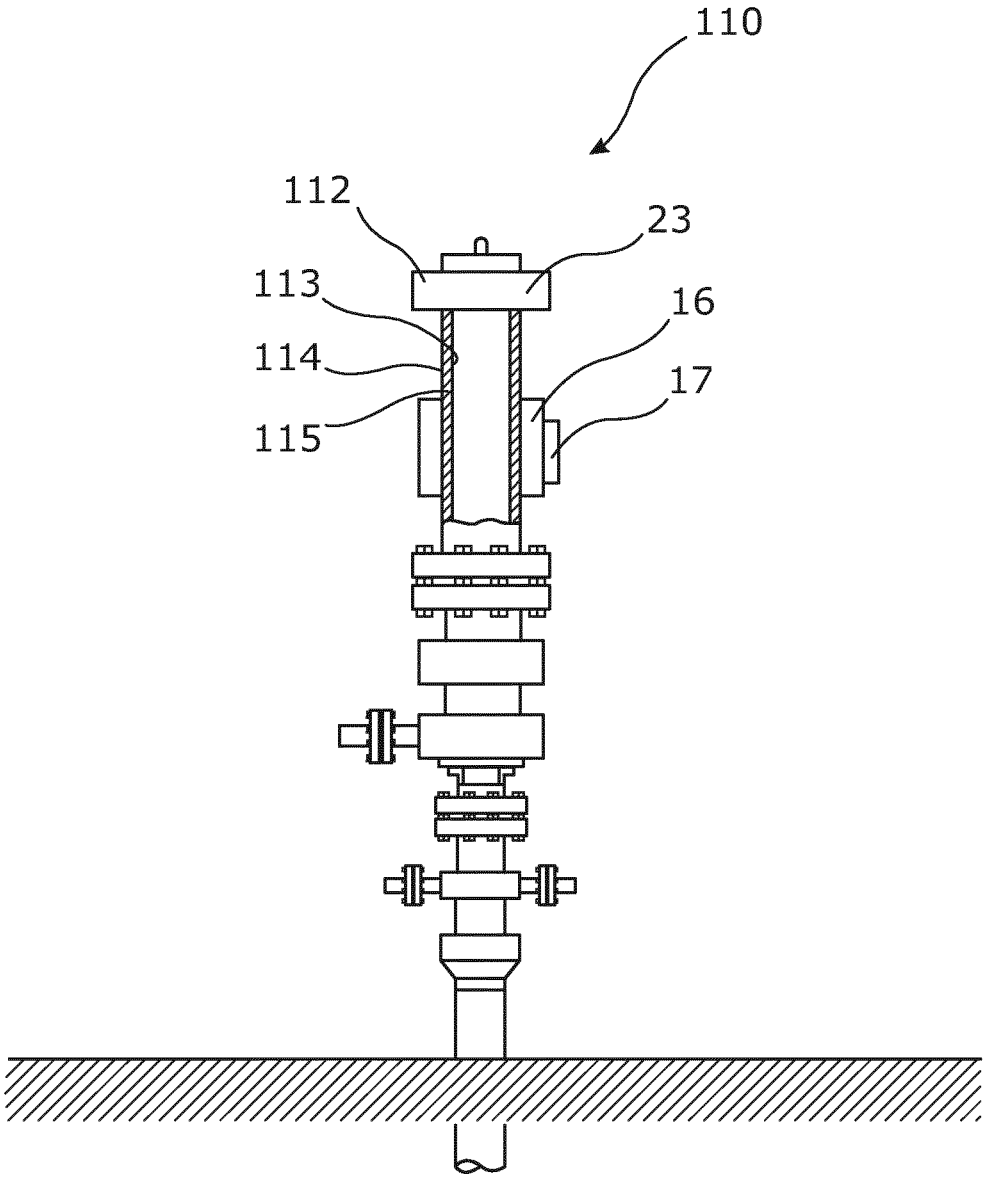
FIG. 3 shows a sound detection device.
Figure 4:
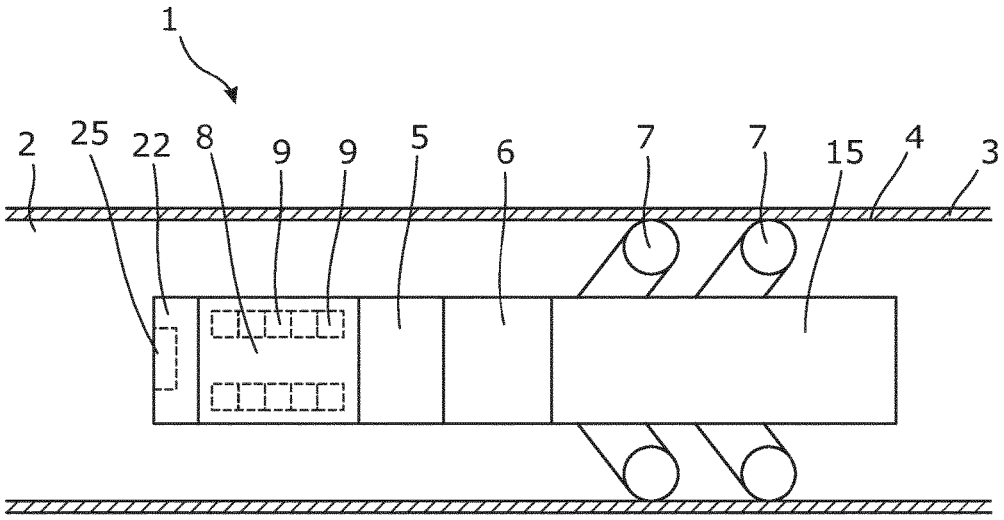
FIG. 4 shows another embodiment of the well head having a recharge connection.

As shown in FIG. 3, the well head 110 comprises a recharge connection 23 at its end for recharging and/or transferring electricity and/or data to and from the wireless unit 1, 100. Thus, the wireless unit 1, 100 comprises a wireless connection 22 for transferring electricity and/or data to and from the wireless unit, as shown in FIG. 4. In order to transfer power or data, the recharge connection 23 may comprise an inductive coupling 24 and the wireless unit 1, 100 may comprise an inductive coupling 25, enabling recharging to be performed inductively without contacts for providing an electrical connection.

The inductive coupling 24 of the recharge connection 23 makes it unnecessary to let the wireless unit 1, 100 out of the fluid-tight well head 110 or well for recharging.

Figure 5:
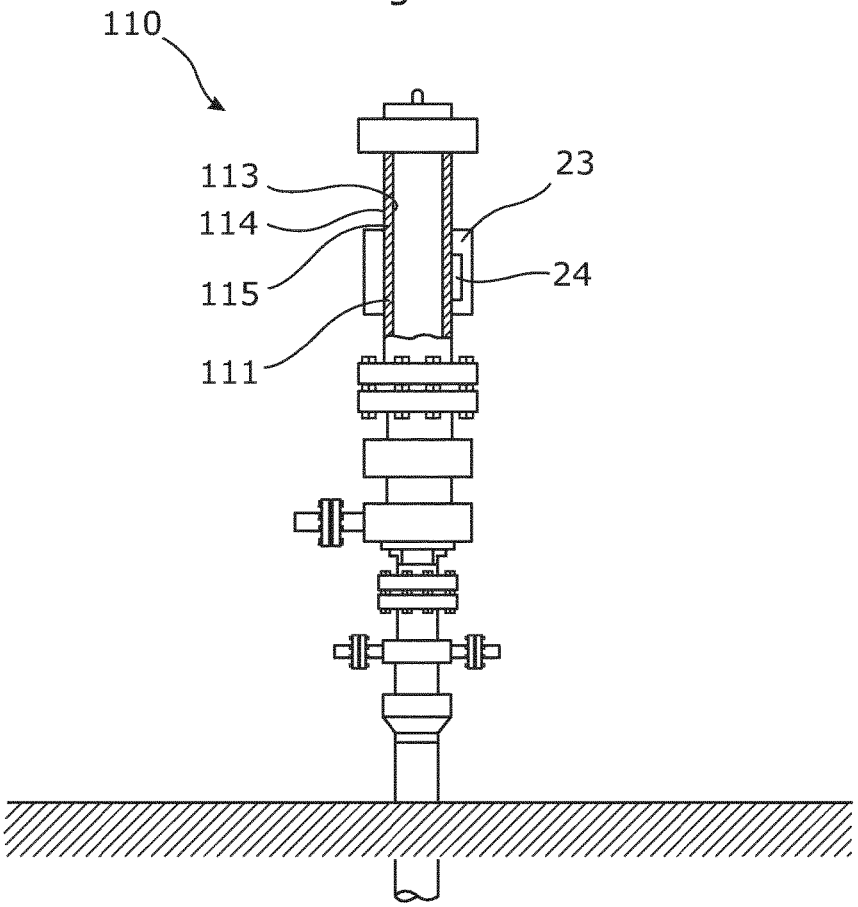
FIG. 5 shows yet another embodiment of the well head having a recharge connection.
Figure 6:
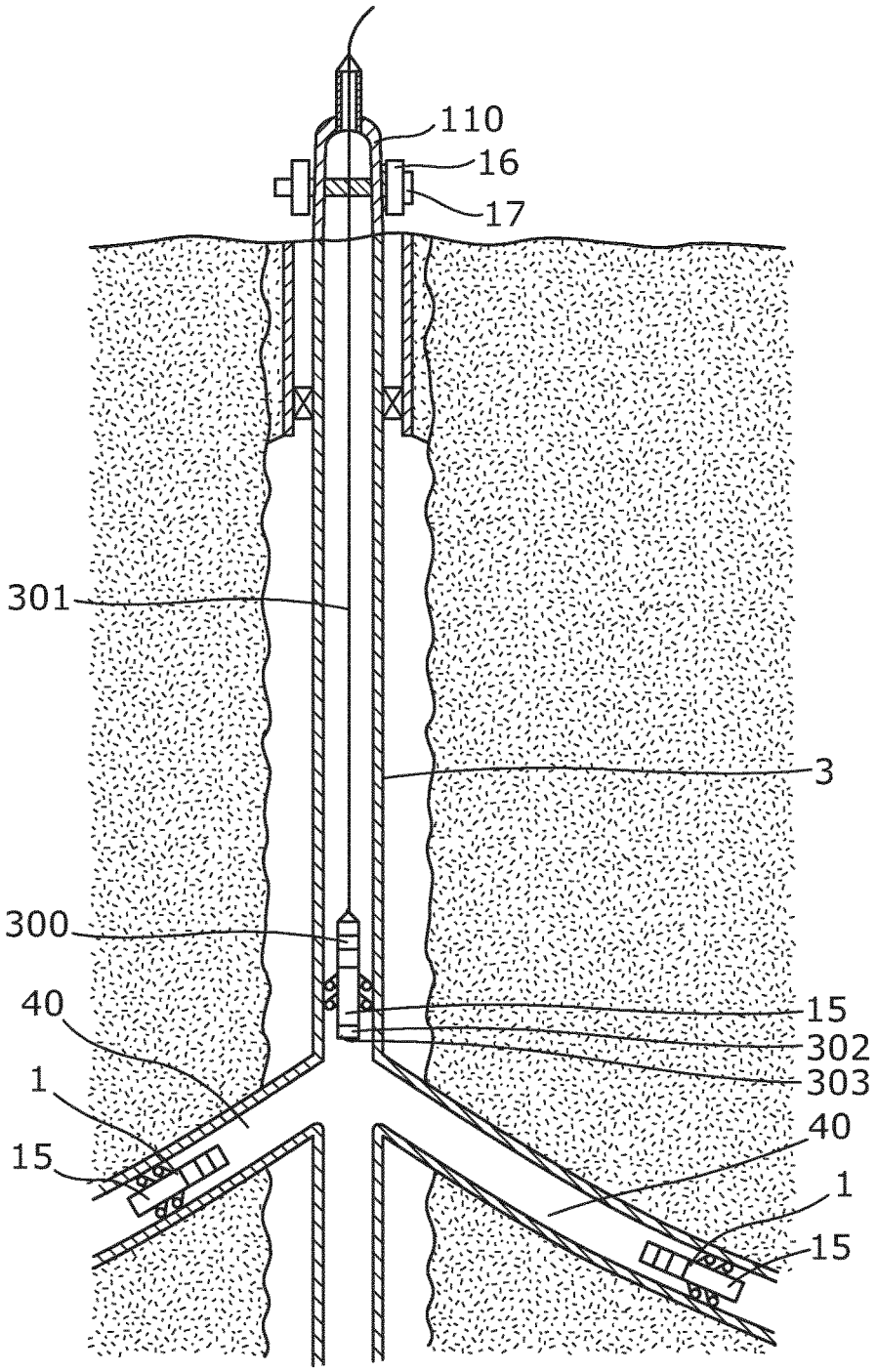
FIG. 6 shows a downhole system having a recharger tool, arranged in the casing.

The recharge connection 23 may also be arranged around the tubular section 111 of the well head 110, as shown in FIG. 5, enabling recharging and/or transfer of electricity and/or data to and from the wireless unit 1, 100 through the wall 115 of the tubular section. By having the recharge connection 23 arranged around the tubular section 111, the recharge connection 23 may easily be mounted around an existing well while the wireless unit 1, 100 performs an operation in that well, and be dismounted again when the wireless unit is no longer required in the well.

The downhole system 200 may also comprise a lubricator which is connectable with the end of the tubular section 21, and the recharge connection 23 may be arranged around the lubricator. This facilitates recharging and/or transfer of electricity and/or data to and from the wireless unit 1, 100 through a wall of the lubricator. The recharge connection 23 may also be arranged at the outer face 114 of the end of the lubricator.

In another embodiment, the downhole system 200 comprises a recharge tool 300 which is submergible in the casing 3 through a wireline 301 or similar powerline. The recharge tool 300 is submerged into the casing when the wireless unit or units 1, 100 have entered. The recharge tool 300 comprises a recharge connection 302 for recharging and/or transferring electricity and/or data to and from the wireless unit 1, 100. Thus, by simply abutting the end of the recharge tool 300 to the recharge tool, the wireless units 1, 100 can be recharged just by ascending to the level of the tool 300. In this way, the wireless unit 1, 100 can be recharged without it being necessary to enter the well head 110 or lubricator, and the wireless unit 1, 100 thereby does not have to waste power travelling the distance from the recharge tool 300 to the well.

The recharge connection 302 comprises an inductive coupling 303 matching an inductive coupling of the wireless units 1, 100.

The recharge tool 300 may also comprise a docking station 21 for connecting with the wireless unit 1, 100 for charging or recharging, or for uploading or downloading information or signals to and from the wireless unit.

By having a downhole system 200 with a recharge tool 300 and several wireless units 1, 100 being powered by a rechargeable battery, the wireless units can operate simultaneously and propel themselves to the recharge tool 300 when in need of power, and subsequently resume their operation. Being able to operate with several wireless units 1, 100 at a time allows for an operation of measuring all sidetracks or laterals 40, e.g. measuring the pressure and temperature, to be performed quicker, thereby enabling faster resumption of the production of hydrocarbons.

A wireless unit 1, 100 in need of recharging does not have to travel the distance from its position to the well head 110 as the recharge tool provides that ability. In this way, both time and energy are saved.

To optimise production, the wireless units 1, 100 may also be permanently arranged in the well to perform continuous measurements of the fluid flowing in the surrounding formation during production.

The docking station 21 may comprise a Universal Series Bus (USB) for enabling communication with the tool when it is docked in the docking station.

The docking station 21 may be electronically connected to a display outside the well so that a diver can send operation instructions to the tool without having to bring the tool out of the well. The tool can upload or download information or signals through the docking station and the display.

When the tool has been down in the well, it connects to the docking station 21, and the data is uploaded to the docking station so that it can be transferred through the display to the ROV of the diver. The diver and/or the ROV comprise a communication unit which is capable of communicating optically with the display and obtaining information about the condition of the well.

By fluid or well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

By a casing is meant any kind of pipe, tubing, tubular, liner, string etc. used downhole in relation to oil or natural gas production.

In the event that the tool is not submergible all the way into the casing, a downhole tractor can be used to push the tool all the way into position in the well. A downhole tractor is any kind of driving tool capable of pushing or pulling tools in a well downhole, such as a Well Tractor®.

Although the invention has been described in the above in connection with preferred embodiments of the invention, it will be evident for a person skilled in the art that several modifications are conceivable without departing from the invention as defined by the following claims.

The invention claimed is:

1. A downhole well system comprising:

a well casing having an inner wall;

a well head coupled to the well casing:

a sound detection device arranged proximate to the well head and comprising a transducer or sensor abutting an outer wall of the well head or abutting a wall above the well head;

a wireless unit comprising a drive unit in the form of wheels and at least one battery pack, the at least one battery pack comprising at least one battery configured to power an electrical motor, the electrical motor driving a pump configured to drive the wheels, the wireless unit being configured to move within the well casing due to rotation of the wheels along the inner wall of the well casing; and a processor;

wherein the sound detection device is configured to, based on signals received from the transducer or the sensor abutting the outer wall of the well head or abutting the wall above the well head, monitor sounds originating within the well casing caused by operation of the wireless unit within the well casing; and the processor is configured to determine a location of the wireless unit within the well casing by interpreting the sounds originating within the well casing caused by movement of the wireless unit within the well casing due to the rotation of the wheels along the inner wall of the well casing and perform a second operation based on the determined location of the wireless unit within the well casing.

2. The downhole system according to claim 1, wherein the sound detection device comprises a display showing the sounds monitored by the sound detecting device.

3. The downhole system according to claim 1, wherein the processor is further configured to calculate a distance from the well head to the wireless unit.

4. The downhole system according to claim 1, further comprising a downhole safety valve arranged in the well casing.

5. The downhole system according to claim 4, wherein the processor is further configured to communicate with the downhole safety valve and instruct the downhole safety valve to open when the wireless unit is within a predetermined distance from the well head.

6. The downhole system according to claim 1, further comprising a docking station enabling the wireless unit to connect thereto in order to be charged or recharged, or to upload or download information or signals to and from the wireless unit.

7. The downhole system according to claim 1, wherein the wireless unit further comprises a wireless connection to transfer electricity and/or data to and from the wireless unit.

8. The downhole system according to claim 1, wherein the well head comprises a recharge connection to recharge and/or transfer electricity and/or data to and from the wireless unit.

9. The downhole system according to claim 8, wherein the well head further comprises a tubular section having a first wall, around which the recharge connection is arranged, enabling recharging and/or transfer of electricity and/or data to and from the wireless unit through the first wall of the tubular section.

10. The downhole system according to claim 8, wherein the well head further comprises a tubular section having an end which has an inner face and an outer face, and wherein the recharge connection is arranged at the outer face of the end, enabling recharging and/or transfer of electricity and/or data to and from the wireless unit through the end of the tubular section.

11. The downhole system according to claim 1, further comprising a recharge tool which is submergible in the well casing.

12. The downhole system according to claim 11, wherein the recharge tool is further submerged via a wireline or a powerline.

13. The downhole system according to claim 11, wherein the recharge tool comprises a recharge connection to recharge and/or transfer electricity and/or data to and from the wireless unit.

14. The downhole system according to claim 13, wherein the recharge connection comprises an inductive coupling to recharge and/or transfer electricity and/or data to and from the wireless unit.

15. The downhole system according to claim 1, wherein the processor is further configured to determine that a specific operation performed by the wireless unit is performed correctly when monitored sounds originating within the well casing caused by operation of the sounds of the wireless unit according to a predefined sound specification corresponding to the specific operation.

16. The downhole system according to claim 1, wherein the second operation performed by the processor is instructing a downhole safety valve arranged in the well casing to open when the processor determines that the location of the wireless unit is in a predetermined location within the well casing.

17. The downhole system according to claim 1, wherein the received signals from the transducer or the sensor correspond to vibrations in the outer wall of the well head or the wall above the well head detected by the transducer or the sensor.

* * * * *